US006493521B2

(12) United States Patent
Miyamoto et al.

(10) Patent No.: US 6,493,521 B2
(45) Date of Patent: Dec. 10, 2002

(54) IMAGE FORMING APPARATUS

(75) Inventors: Toshio Miyamoto, Shizuoka (JP); Hiroto Hasegawa, Shizuoka (JP); Satoru Izawa, Shizuoka (JP); Masahiko Suzumi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/778,894

(22) Filed: Feb. 8, 2001

(65) Prior Publication Data

US 2001/0041078 A1 Nov. 15, 2001

(30) Foreign Application Priority Data

Feb. 10, 2000 (JP) ..... 2000-033257

(51) Int. Cl.[7] ..... G03G 15/00; G03G 15/20
(52) U.S. Cl. ..... 399/44; 399/69; 399/70
(58) Field of Search ..... 399/44, 67, 69, 399/70, 328, 329

(56) References Cited

U.S. PATENT DOCUMENTS

| | | | | |
|---|---|---|---|---|
| 5,253,024 A | | 10/1993 | Okuda et al. | |
| 5,280,328 A | * | 1/1994 | Goto et al. | 399/70 |
| 5,293,202 A | | 3/1994 | Adachi et al. | |
| 5,365,314 A | * | 11/1994 | Okuda et al. | 399/69 |
| 5,600,406 A | * | 2/1997 | Aikawa et al. | 399/70 |
| 5,682,576 A | | 10/1997 | Sakai et al. | 399/69 |
| 5,729,789 A | * | 3/1998 | Tamaki | 399/70 |
| 5,771,421 A | * | 6/1998 | Kim | 399/44 |
| 5,920,757 A | | 7/1999 | Izawa et al. | 399/329 |
| 5,960,233 A | | 9/1999 | Goto et al. | 399/69 |
| 5,991,555 A | | 11/1999 | Suzumi et al. | 399/18 |
| 6,115,563 A | | 9/2000 | Miyamoto | 399/67 |
| 6,185,383 B1 | | 2/2001 | Kanari et al. | 399/45 |

FOREIGN PATENT DOCUMENTS

| | | | |
|---|---|---|---|
| JP | 4-032884 | * | 2/1992 |
| JP | 8-76636 | | 3/1996 |
| JP | 8-152802 | * | 6/1996 |
| JP | 9-16017 | | 1/1997 |

* cited by examiner

*Primary Examiner*—Sandra Brase
(74) *Attorney, Agent, or Firm*—Fitzpatrick, Cella, Harper & Scinto

(57) ABSTRACT

An object of the present invention is to provide an image forming apparatus having a fixing device, which can obtain good fixing ability while preventing occurrence of hot offset. The present invention provides an image forming apparatus that has image forming means for forming an image on a recording material, a heating member for heating the image on the recording material, a backup roller forming a nip with the heating member, a temperature detecting element for detecting a temperature of an atmosphere, and control means for controlling a power supply to the heating member, wherein when a print signal is inputted, the control means controls power supply (electrical communication) to the heating member in such a manner that the heating member maintains a set temperature in accordance with a detection temperature of the temperature detecting element, and, thereafter, a fixing operation is effected.

20 Claims, 5 Drawing Sheets

IMAGE FORMING APPARATUS

BACKGROUND OF THE INVENTION

1. Field of the Invention

The present invention relates to an image forming apparatus such as a copying machine, a printer and the like, and more particularly, it relates to an image forming apparatus including a fixing device having low heat capacity.

2. Related Background Art

In some copying machines and printers, there is provided a fixing device for thermally fixing an image formed on a recording material.

As kinds of the fixing device, there are a heat roller system in which a recording material is pinched and conveyed by a pair of rollers, a film heating system in which a film shifted while being contacted with a heater is used, and induction heating system in which a principle of electromagnetic induction is used. Particularly, since fixing devices of film heating type and of induction heating type have very low heat capacity, heating of the heater can be started after a print signal is inputted and the heating during a waiting condition can be stopped, with the result that such fixing devices save power consumption and are inexpensive.

A most fundamental performance of function required for the fixing device is that a toner image formed on a recording material is thermally fixed without excess and deficiency. This fixing ability depends upon a total amount applied to the toner image being passed through a nip of the fixing device. For example, if a temperature of an environment is high, since temperatures of a pressurizing roller and of the recording material may possibly be high relatively, even when a temperature adjustment temperature during the fixing is relatively low, the total heat amount required for the toner can be obtained. To the contrary, if the environmental temperature is low, since the pressurizing roller and the recording material may possibly be cold, the temperature adjustment temperature during the fixing must be increased to obtain the total heat amount required for the toner.

However, for the purpose of achieving the total heat amount required for the toner, if the temperature adjustment temperature during the fixing is made too high, the toner is heated abruptly, thereby generating a phenomenon (called as "hot offset") in which a portion of the toner image is adhered to the film. If the toner is adhered to the film, endurance of the film may be worsened or the fixing ability may be worsened.

In this way, although the fixing device having low heat capacity in which the heating is started after the print signal is inputted has merits such as low power consumption and cheapness, since the heating is not effected during the waiting condition for waiting the print signal, the pressurizing roller is frequently cold under the low environmental temperature. Accordingly, if the temperature adjustment temperature is not set to be high, the adequate fixing ability cannot be obtained, thereby generating the hot offset.

SUMMARY OF THE INVENTION

The present invention is made in consideration of the above circumstances, and an object of the present invention is to provide an image forming apparatus having a fixing device, which can obtain good fixing ability while preventing occurrence of hot offset.

Another object of the present invention is to provide an image forming apparatus having a fixing device, which can prevent hot offset while maintaining low power consumption.

A further object of the present invention is to provide an image forming apparatus comprising image forming means for forming an image on a recording material, a heating member for heating the image on the recording material, a backup roller forming a nip with the heating member, a temperature detecting element for detecting a temperature of an atmosphere, and control means for controlling a power supply to the heating member, wherein when a print signal is inputted, the control means controls power supply (electrical communication) to the heating member in such a manner that the heating member maintains a set temperature in accordance with a detection temperature of the temperature detecting element, and, thereafter, a fixing operation is effected.

A still further object of the present invention is to provide an image forming apparatus comprising image forming means for forming an image on a recording material, a heating member for heating the image on the recording material, a backup roller forming a nip with the heating member, a temperature detecting element for detecting a temperature of an atmosphere, and control means for controlling a power supply to the heating member, and wherein, when a print signal is inputted, the control means controls electrical communication to the heating member in such a manner that the heating member maintains a set temperature by a set time corresponding to a detection temperature of the temperature detecting element, and, thereafter, a fixing operation is effected.

The other objects and features of the present invention will be apparent from the following detailed explanation referring to the accompanying drawings.

DETAILED DESCRIPTION OF THE PREFERRED EMBODIMENTS

The present invention will now be fully explained in connection with embodiments thereof with reference to the accompanying drawings.

(First Embodiment)

Figure 1:
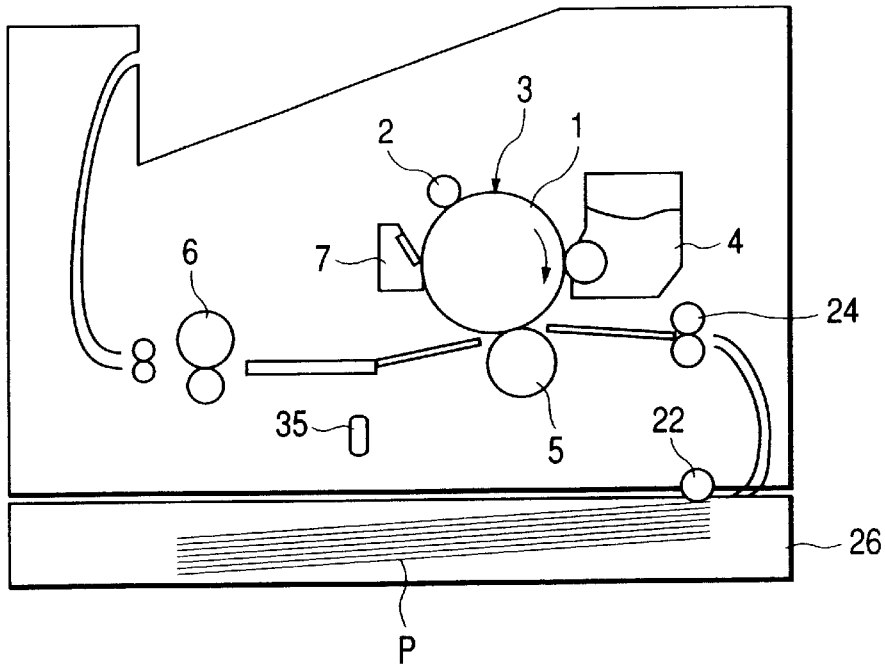
FIG. 1 is a sectional view showing a schematic construction of an image forming apparatus according to a first embodiment of the present invention.

FIG. 1 is a schematic sectional view of an image forming apparatus according to a first embodiment of the present invention.

As shown in FIG. 1, the image forming apparatus has a photosensitive drum 1 as an image bearing member constituted by forming a layer of photosensitive material such as OPC around a cylindrical substrate made of aluminium or nickel.

In such an image forming apparatus, first of all, a surface of the photo sensitive drum 1 is uniformly charged by a charging roller 2 as a charging apparatus. Then, a laser beam 3 is ON/OFF-controlled by exposing means (not shown) in response to image information to effect exposure-scanning on the photosensitive drum 1, thereby forming an electrostatic latent image on the photosensitive drum 1. The electrostatic latent image is developed by a developing apparatus 4 to be visualized as a toner image. A jumping developing method or the like is used as a developing method, and, in many cases, a combination of image exposure and reversal developing is used.

A recording material P as a recording medium is picked up from a manual insertion tray 21 or a cassette 26 by means of a sheet feeding roller 22 and is sent to a registration roller pair 24. By the action of the registration roller pair 24, the recording material P is supplied to a transfer nip portion defined between the photosensitive drum 1 and a transfer roller 5 in synchronous with the toner image formed on the photosensitive drum 1. In the transfer nip portion, the toner image formed on the photosensitive drum 1 is transferred onto the recording material P by the action of transfer bias from a power source (not shown). The recording material P holding the toner image is conveyed to a fixing apparatus 6, where the toner image is heated and pressurized in a nip portion of the fixing apparatus 6 to be permanently fixed to the recording material P. Thereafter, the recording material is discharged out of the apparatus. On the other hand, after the transferring, transfer-residual toner remaining on the photosensitive drum 1 is removed from the surface of the photosensitive drum 1 by means of a cleaning apparatus 7.

The image forming apparatus according to the illustrated embodiment includes a thermistor 35 as temperature detecting means for detecting a temperature of atmosphere (outdoor temperature). An attachment position of the thermistor 35 is selected so that the thermistor can measure the temperature of atmosphere and is not subjected to an influence of increase in temperature within the image forming apparatus. More specifically, the thermistor may be installed in the vicinity of a vent hole formed in an outer cover apt to be contacted with atmosphere (outdoor air) or in the vicinity of an outdoor air inlet of an air path of a main body of the apparatus.

Next, construction and operation of the fixing apparatus 6 will be explained.

Figure 2:
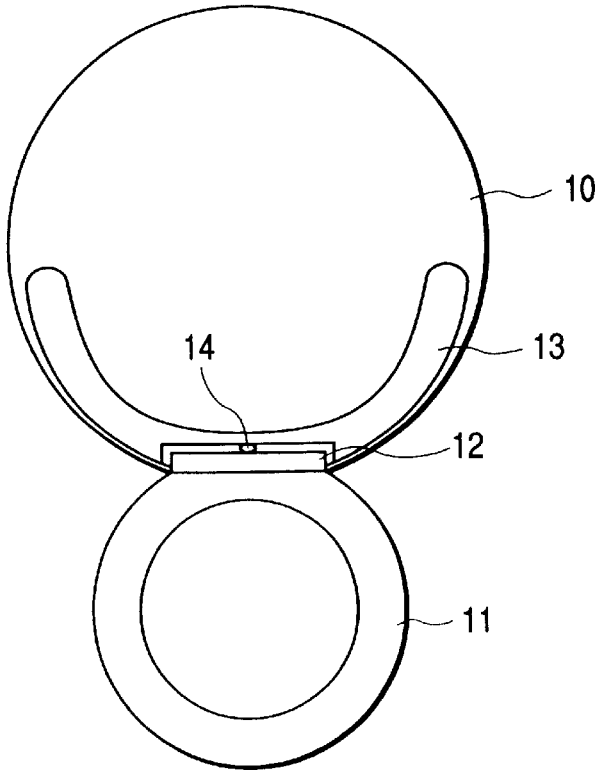
FIG. 2 is a sectional view showing a schematic construction of a fixing apparatus incorporated into an image forming apparatus of FIG. 1.

FIG. 2 is a schematic sectional view of a fixing apparatus of film heating type as an example of the fixing apparatus 6 to which the present invention is applied.

As shown in FIG. 2, the fixing apparatus 6 has a heat-resistive endless fixing film 10 mounted, with excessive circumferential length, around a semi-circular film guide member (stay) 13.

The fixing film 10 has a total film thickness smaller than 100 $\mu$m (60 $\mu$m in the illustrated embodiment) in order to reduce heat capacity and improve quick-start ability. The film is formed from a single film made of PTFE, PFA or PPS which has heat resistance, mold releasing ability, strength and endurance or a composite film constituted by coating PTFE, PFA or FEP as a mold releasing layer on a film surface formed from polyimide, polyamide-imide, PEEK or PES.

Further, the fixing apparatus 6 as a ceramic heater 12 as heating means including a heat generating body formed by printing heat generating paste on a ceramic substrate, and a glass coating layer for ensuring protection and insulation of the heat generating body.

The ceramic heater 12 generates heat by applying power-controlled AC electrical current to the heat generating body on the ceramic heater 12. A chip thermistor 14 is adhered to a back surface of the ceramic substrate. Heater driving means (not shown) is controlled on the basis of detection output of the chi thermistor 14 to effect electrical power control to the ceramic heater 12, thereby keeping a heater temperature in a target temperature.

Further, the fixing apparatus 6 has a pressurizing roller 11 as a rotary member constituted by forming an elastic layer made of heat-resistive rubber such as silicone rubber or an elastic layer made of silicone rubber on a core cylinder. Incidentally, a heat-resistive mold releasing layer made of fluororesin such as PFA, PTFE or FEP may be provided on the elastic layer.

The pressurizing roller 11 is urged against the ceramic heater 12 with the interposition of the fixing film 10 by a spring (not shown) and is rotatingly driven by a driving system (not shown) as driving means so that the recording material P and the fixing film 10 are rotatingly driven and conveyed by the pressurizing roller 11.

When the image forming apparatus receives the print signal, the fixing film 10 and the pressurizing roller 11 start idle rotation for preparation prior to print (referred to as "ante-rotation" hereinafter). In this case, the electrical communication to the ceramic heater 12 of the fixing apparatus 6 is started, thereby rising the fixing apparatus 6. After a predetermined time period is elapsed (after rising time of about five seconds in the illustrated embodiment), a temperature of the ceramic heater 12 of the fixing apparatus 6 is increased up to 170° C. In synchronous with this timing, the image forming operation is performed, so that the recording material carrying the non-fixed toner image is sent to the fixing apparatus 6. While the recording material is being conveyed up to the fixing nip, the temperature of the ceramic heater 12 is further increased to reach a fixing temperature adjustment temperature 190° C. for the print. Then, the fixing operation is effected.

The non-fixed toner image on the recording material is heated and pressurized in a abut nip portion defined between a heating portion (fixing film 10 and ceramic heater 12) and the pressurizing roller 11 of the fixing apparatus 6 thereby to fix the toner image to the recording material. After the fixing, the recording material P is discharged out of the apparatus.

In the illustrated embodiment, the present invention is characterized in that the ante-rotation time is changed in accordance with the detection temperature of the thermistor 35 as the temperature of atmosphere detecting sensor.

Figure 3:
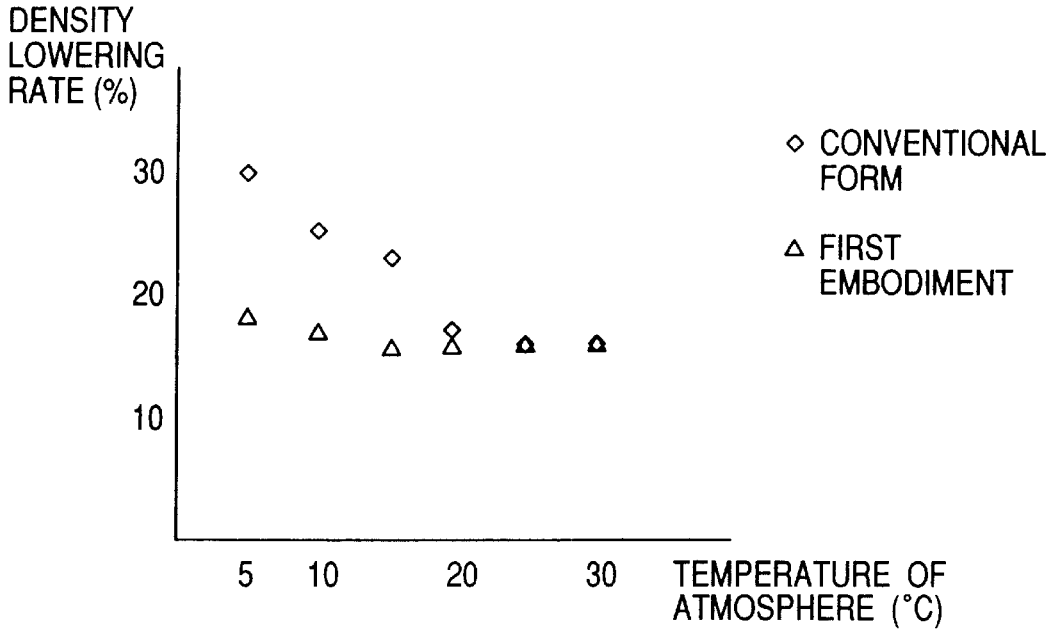
FIG. 3 is a graph showing a relationship between a temperature of atmosphere and a fixing ability in the fixing apparatus according to the first embodiment of the present invention and in a conventional fixing apparatus.

FIG. 3 is a graph showing a relationship between the temperature of atmosphere and the fixing ability of the image forming apparatus according to the illustrated embodiment.

In FIG. 3, the ordinate indicates a density lowering rate obtained when a printed sample is rubbed by a predetermined method and density before rubbing and density after rubbing are compared. The density lowering rate indicates the fact that the fixing ability is worsened as the value of the density lowering ratio is increased.

As shown in FIG. 3, in the conventional form as a comparative example, the fixing ability is worsened as the temperature of atmosphere is decreased.

To the contrary, in the illustrated embodiment, the ante-rotation time is extended in accordance with the temperature of atmosphere detected by the thermistor 35 in such a manner that extension by 10 seconds is effected when the temperature of atmosphere is smaller than 10° C. and extension by 5 seconds is effected when the temperature of atmosphere is greater than 10° C. (including 10° C.) and smaller than 20° C. and no extension is effected when the temperature of atmosphere is greater than 20° C. (including 20° C.). During the ante-rotation, temperature control is effected so that the temperature of the heater 12 is maintained to 170° C.

Thus, as shown by the graph of FIG. 3 regarding the illustrated embodiment, even in the low temperature environment, by warming the pressurizing roller 11 by the ante-rotation extension mode, good fixing ability not greater than 20% can be obtained. In case of the conventional form, it was found that, when the extension of the ante-rotation was not effected under the temperature of atmosphere of 5° C. and the fixing temperature during the print was merely increased to 205° C. rather than 190° C., although the fixing ability was improved to about 15%, poor image due to hot offset was generated. As mentioned above, in order to maintain the fixing ability and prevent the hot offset, it is effective that the heating is effected from both heater and pressurizing roller sides, rather than the fact that heat is given by increasing the temperature of the heater.

Figure 4:
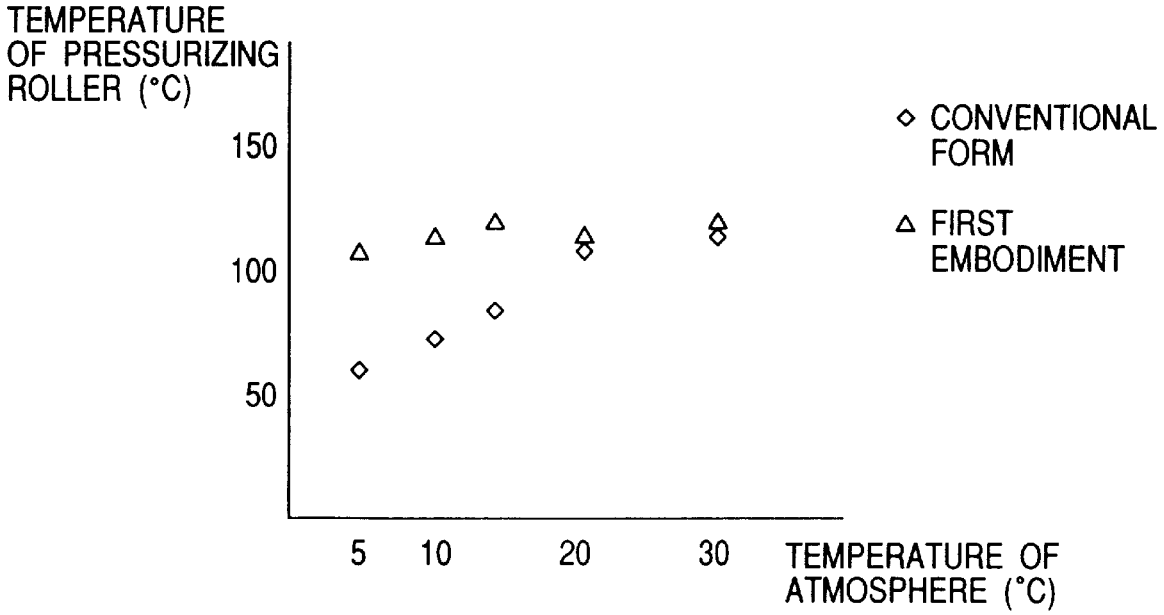
FIG. 4 is a graph showing a relationship between a temperature of atmosphere and a temperature of a pressurizing member in the fixing apparatus according to the first embodiment of the present invention and in a conventional fixing apparatus.

FIG. 4 is a graph showing the temperature of the pressurizing roller immediately before a first page recording material enters into the fixing apparatus when the print is effected from a first run (an early) in the morning condition, i.e., a condition that the pressurizing roller 11 is cold.

In the conventional form, since the ante-rotation time is constant (about 5 seconds) regardless of the temperature of atmosphere, the time period during when the pressurizing roller is heated is also constant (about 5 seconds). Since the temperature of the pressurizing roller in the early in the morning condition is substantially equal to the temperature of atmosphere, the lower the temperature of atmosphere the lower the temperature of the pressurizing roller after the rising-up. This is one factor for worsening the fixing ability.

On the other hand, in the illustrated embodiment, if the temperature of atmosphere is low, since the ante-rotation time is extended, the heating time for the pressurizing roller 11 is lengthened, so that the temperature of the pressurizing roller 11 becomes the substantially the same, regardless of the temperature of atmosphere.

As mentioned above, in the present invention, by providing the thermistor 35 for measuring the temperature of atmosphere of the image forming apparatus and by changing the ante-rotation time in accordance with the temperature of atmosphere detected by the thermistor 35, constant fixing ability can be obtained regardless of the temperature of atmosphere, and, at the same time, occurrence of the hot offset can be prevented.

(Second Embodiment)

Next, a second embodiment of the present invention will be explained. Incidentally, the same elements as those in the first embodiment are designated by the same reference numerals and explanation thereof will be omitted.

In the second embodiment, the present invention is characterized in that the ante-rotation time before the print is changed in accordance with the detection temperature of the temperature of atmosphere detecting sensor and a size of the recording material. More specifically, when the size of the recording material is small, the ante-rotation time is more extended than a large size.

Further, in this embodiment, the printer is designed to be mainly used with recording materials of A4 size, LTR size and LGL size, and, regarding smaller sizes such as B5 size, Executive size, A5 size and envelope size, since a temperature of a non-sheet passing area of the ceramic heater 12 may be increased due to narrower sheet size, through-put (the number of passing sheets per unit time) is decreased. In case of the recording material having A4, size, LTR size or LGL size, although the print speed is 16 sheets/min (16 ppm), in case of the recording material having smaller size such as an envelope, the through-put is decreased to the print speed of 9 ppm. In this case, although the print speed is decreased, in the small sheet size, since the print speed is not so important, there is no problem. Further, since the envelope has a greater thickness, if the through-put is set to 16 ppm, it is disadvantageous in the viewpoint of the fixing ability.

Figure 5:
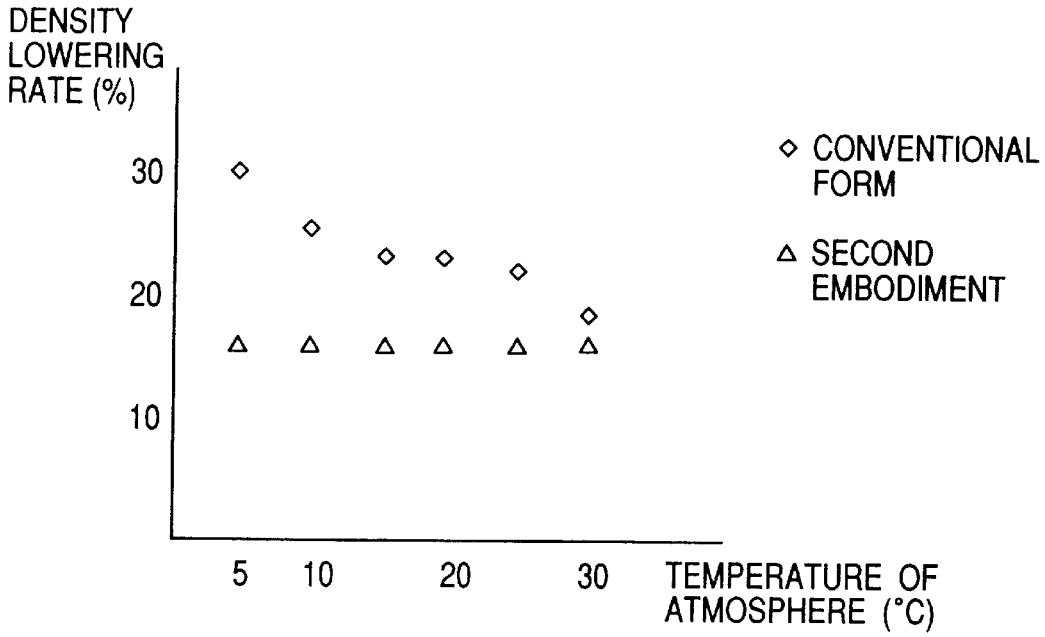
FIG. 5 is a graph showing a relationship between a temperature of atmosphere and a fixing ability in a fixing apparatus according to a second embodiment of the present invention and in a conventional fixing apparatus.

FIG. 5 shows a relationship between the temperature of atmosphere and the density lowering rate when the envelope is printed. An envelope having COM10 size was used. A fixing apparatus according to a conventional form shown as a comparative example in FIG. 5 is designed to effect the printing operation immediately after the rising time of the apparatus of about 5 seconds. In the conventional form, although the fixing ability was in a level not greater than 20% only when the temperature of atmosphere is high (about 30° C.), the fixing ability was not allowable (i.e., exceeded 20%) under the other temperatures. To the contrary, in the illustrated embodiment, the rising-up time of the fixing apparatus is extended by 10 seconds when the temperature of atmosphere is smaller than 10° C. and is extended by 5 seconds when the temperature of atmosphere is greater than 10° C. (including 10° C.) and smaller than 30° C. and is not extended when the temperature of atmosphere is greater than 30° C. (including 30° C.). In this way, the temperature of the pressurizing roller 11 can be increased, and, the fixing ability can be improved even when the set temperature during the fixing is not increased. Further, in case of the small size sheet, since the ante-rotation is extended even in the temperature of atmosphere of 20° C. to 30° C., the heater 12 adapts itself to the high temperature condition before the fixing, thereby suppressing the distortion of the heater after the small size sheet was passed.

Figure 6:
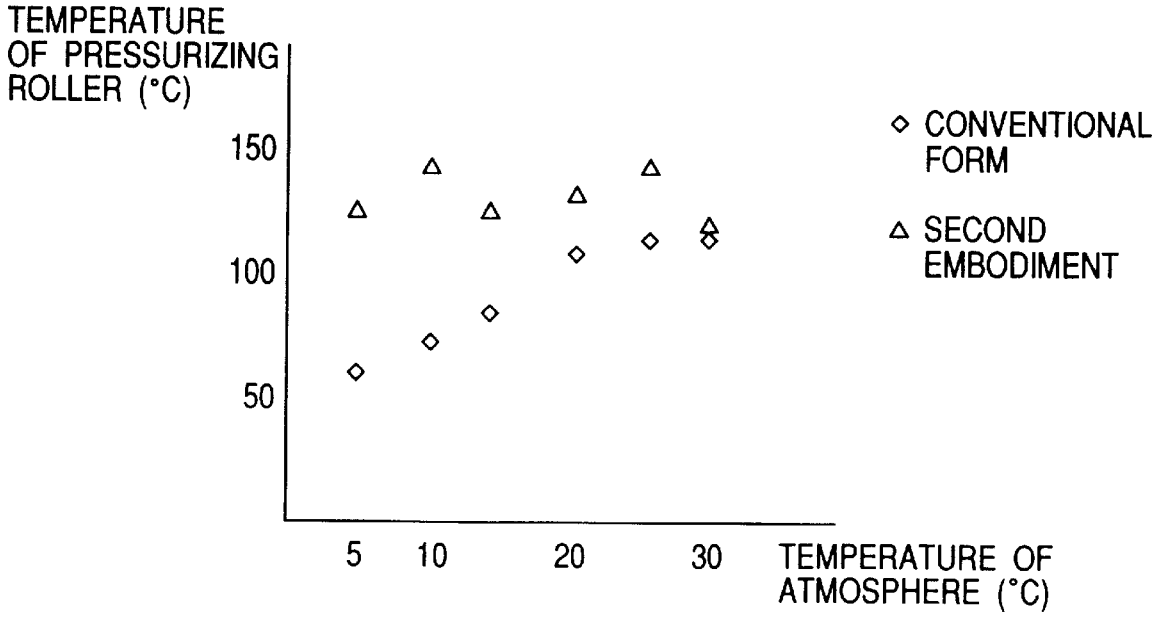
FIG. 6 is a graph showing a relationship between a temperature of atmosphere and a temperature of a pressurizing member in the fixing apparatus according to the second embodiment of the present invention and in a conventional fixing apparatus.

FIG. 6 is a graph showing comparison between the illustrated embodiment and the conventional form regarding the temperature of the pressurizing roller. Such temperature of a temperature of the pressurizing roller immediately before a first page recording material enters into the fixing apparatus when the print is effected from an early in the morning condition. In the comparative example (conventional form), since the ante-rotation time is constant (about 5 seconds) regardless of the temperature of atmosphere, the time period during when the pressurizing roller is heated is also about 5 seconds. Since the temperature of the pressurizing roller in the early in the morning condition is substantially equal to the temperature of atmosphere, the lower the temperature of atmosphere the lower the temperature of the pressurizing roller after the rising-up.

On the other hand, in the illustrated embodiment, if the temperature of atmosphere is low, since the ante-rotation time is extended by 10 seconds, the heating time for the pressurizing roller 11 is lengthened, so that the temperature of the pressurizing roller 11 is maintained in about 120 to 140° C. Further, since the ante-rotation time is extended by 5 seconds even in the temperature of atmosphere of 10 to 30° C., the temperature of the pressurizing roller 11 is greater than the comparative example and is maintained in about 120 to 140° C. In this way, the temperature of the pressurizing roller 11 is maintained to high temperature regardless of the temperature of atmosphere.

As a result, when the fixing ability in FIG. 5 is observed, in the illustrated embodiment, the fixing ability is maintained in the good level not greater than 20%, and the hot offset was not generated and the good fixing ability could be obtained.

(Third Embodiment)

Next, a third embodiment of the present invention will be explained. Incidentally, the same elements as those in the first embodiment are designated by the same reference numerals and explanation thereof will be omitted.

In the third embodiment, the present invention is characterized in that the ante-rotation time before the print is changed with a predetermined linear function in accordance with the detection temperature of the thermistor 35 as the temperature of atmosphere detecting sensor.

In the third embodiment, if the temperature of atmosphere T [° C.] is smaller than 20° C., the ante-rotation time is extended by [(20−T)×1.1] seconds. The lower the temperature of atmosphere the longer the extension of the ante-rotation time, for example, in such a manner that no extension is effected at T=20° C., extension of 1.1 seconds is effected at T=19° C., extension of 2.2 seconds is effected at T=18° C. and so on.

Figure 7:
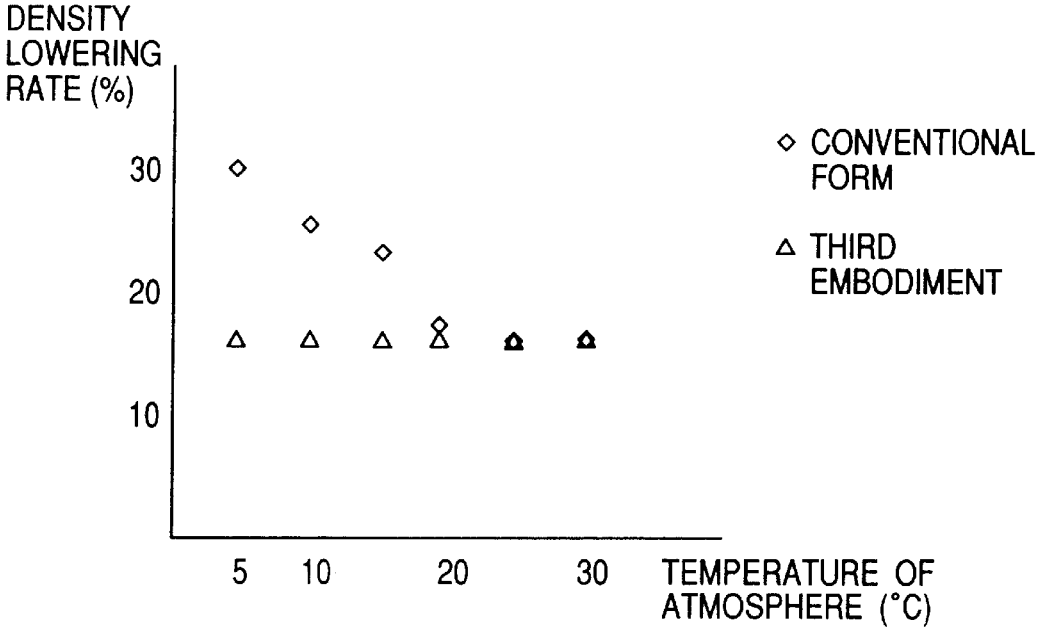
FIG. 7 is a graph showing a relationship between a temperature of atmosphere and a fixing ability in a fixing apparatus according to a third embodiment of the present invention and in a conventional fixing apparatus.

FIG. 7 is a graph showing a relationship between the temperature of atmosphere of the image forming apparatus and the density lowering rate in the illustrated embodiment. As can be seen from the graph of FIG. 7, in the conventional form as a comparative example, the fixing ability is worsened as the temperature of atmosphere is lowered.

To the contrary, in the illustrated embodiment, since the ante-rotation time is extended in accordance with the temperature of atmosphere as mentioned above, the hot offset was not generated and the good fixing ability could be obtained.

Figure 8:
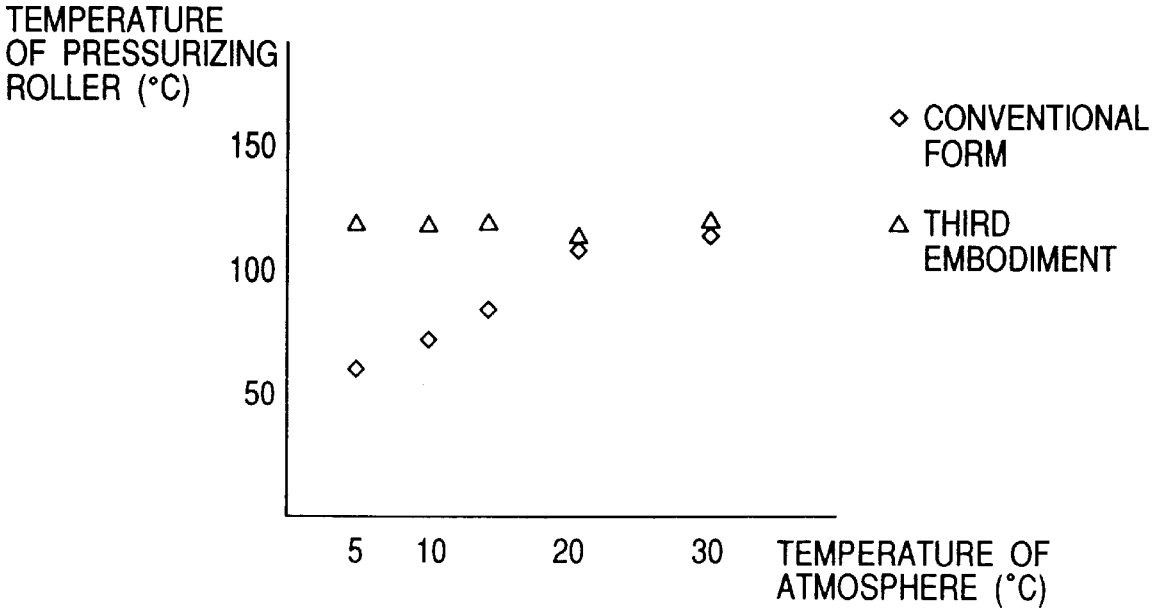
FIG. 8 is a graph showing a relationship between a temperature of atmosphere and a temperature of a pressurizing member in the fixing apparatus according to the third embodiment of the present invention and in a conventional fixing apparatus.

FIG. 8 is a graph showing comparison between the illustrated embodiment and the conventional form regarding the temperature of the pressurizing roller. Such temperature of a temperature of the pressurizing roller immediately before a first page recording material enters into the fixing apparatus when the print is effected from an early in the morning condition. In the conventional form as an comparative example, since the ante-rotation time is constant (about 5 seconds) regardless of the temperature of atmosphere, the time period during when the pressurizing roller is heated is also about 5 seconds. Since the temperature of the pressurizing roller in the early in the morning condition is substantially equal to the temperature of atmosphere, the lower the temperature of atmosphere the lower the temperature of the pressurizing roller after the rising-up.

On the other hand, in the illustrated embodiment, if the temperature of atmosphere is smaller than 20° C., since the ante-rotation time is extended in accordance with the temperature of atmosphere, the temperature of the pressurizing roller 11 is stabilized at about 120° C. under the temperature of atmosphere smaller than 20° C. In this way, the temperature of the pressurizing roller 11 can be kept constant regardless of the temperature of atmosphere, stable fixing ability not affected by the influence of the temperature of atmosphere can be obtained and the hot offset can be prevented.

In the illustrated embodiment, while an example that the function by which, if the temperature of atmosphere T [° C.] is smaller than 20° C., the ante-rotation time is extended by [(20−T)×1.1] seconds is used was explained, the present invention is not limited to such an example, an optimum function may be used from an image forming apparatus to an image forming apparatus.

(Fourth Embodiment)

Next, a fourth embodiment of the present invention will be explained. Incidentally, the same elements as those in the first embodiment are designated by the same reference numerals and explanation thereof will be omitted.

In the fourth embodiment, the present invention is characterized in that the temperature adjustment temperature of the ceramic heater 12 during the ante-rotation is changed in accordance with the temperature of atmosphere thereby to improve the fixing ability.

When the image forming apparatus receives the print signal, the ante-rotation as a preparation stage prior to the print is started. In this case, the electrical communication to the heater of the fixing apparatus and the rotation of the pressurizing roller are started, thereby rising up the fixing apparatus. The temperature adjustment temperature at the rising-up is referred to as "ante-rotation temperature adjustment temperature". After the rising-up, the temperature of the fixing apparatus is increased to the print fixing temperature until the fed recording material actually reaches the fixing nip portion. The ante-rotation temperature adjustment temperature was set to 170° C. and the print temperature adjustment temperature was set to 190° C.

Further, in the illustrated embodiment, the ante-rotation temperature adjustment temperature is changed in accordance with the temperature of atmosphere in the following manner.

When the temperature of atmosphere is smaller than 10° C. the ante-rotation temperature adjustment temperature is set to 210° C., and, when temperature of atmosphere is greater than 10° C. (including 10° C.) and smaller than 20° C. the ante-rotation temperature adjustment temperature is set to 195° C., and, when temperature of atmosphere is greater than 20° C. (including 20° C.) the ante-rotation temperature adjustment temperature is set to 170° C.

When the ante-rotation temperature adjustment temperature is set to be high in this way, since a heat amount transmitted to the pressurizing roller 11 is increased, the temperature of the pressurizing roller 11 can be increased during the ante-rotation. For example, the temperature setting is changed in a timed relation so that, even when the ante-rotation temperature is set to be high as 210° C. at the temperature of atmosphere smaller than 10° C. (not including 10° C.), the temperature is lowered to the print temperature adjustment temperature of 190° C. at the timing when a leading end of the recording material enters into the fixing nip portion.

Figure 9:
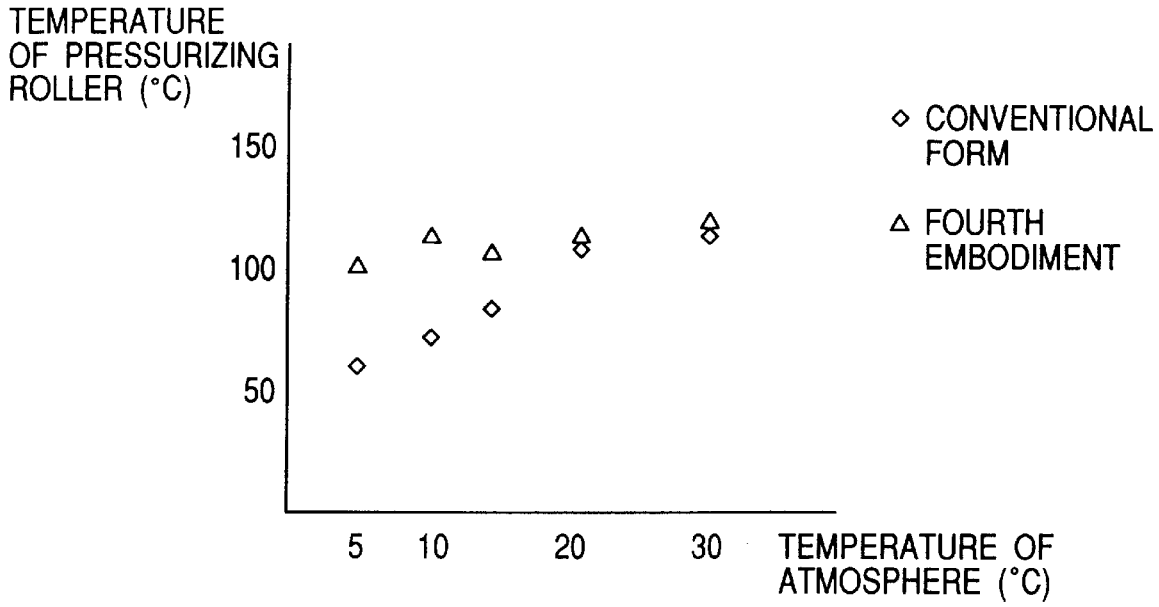
FIG. 9 is a graph showing a relationship between a temperature of atmosphere and a temperature of a pressurizing member in the fixing apparatus according to a fourth embodiment of the present invention and in a conventional fixing apparatus.

FIG. 9 is a graph showing a relationship between the temperature of atmosphere and the temperature of the pressurizing roller at the end of the ante-rotation. As a comparative example, in the conventional form, the temperature of the pressurizing roller is decreased as the temperature of atmosphere is decreased. To the contrary, in the illustrated embodiment, when the temperature of atmosphere is low, the reduction of the temperature of the pressurizing roller is suppressed to about 10° C. to be maintained not smaller than 95° C.

Figure 10:
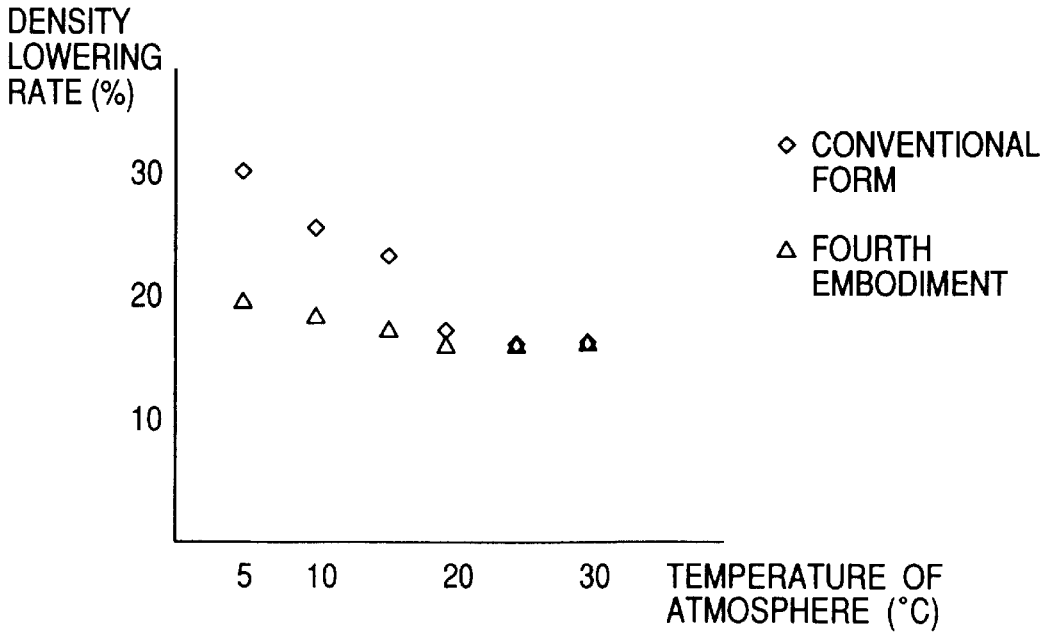
FIG. 10 is a graph showing a relationship between a temperature of atmosphere and a fixing ability in a fixing apparatus according to the fourth embodiment of the present invention and in a conventional fixing apparatus.

FIG. 10 shows a result of density lowering rates in the illustrated embodiment and the conventional form.

As can be seen from FIG. 10, in the illustrated embodiment, the density lowering rate (fixing ability) becomes constant regardless of the temperature of atmosphere, in contrast to the conventional form as the comparative example. As a result, good fixing ability can be obtained and the hot offset can be prevented. On the other hand, in the comparative example, when the temperature of atmosphere is 5° C., if only the fixing temperature was increased to 205° C. while maintaining the ante-rotation temperature adjustment temperature to 170° C. as it is, although the fixing ability could be improved, the hot offset was generated. When the fixing temperature was selected to 195° C., although the hot offset was prevented, the density lowering rate was more or less improved as 23% but was insufficient.

Further, in the illustrated embodiment, while an example that, when the temperature of atmosphere is smaller than 20° C. (not including 20° C.), the ante-rotation temperature is set to be higher than the print temperature to enhance the temperature increasing effect of the pressurizing roller 11 during the ante-rotation was explained, the ante-rotation temperature may be set to about a temperature same as the setting temperature for the fixing (print temperature) and the temperature of the pressurizing roller 11 may be increased. In this case, in order to sufficiently increase the temperature of the pressurizing roller 11, it is effective to combine the above technique with the slight extension of the ante-rotation time. When the ante-rotation time is extended, although a first print time is slightly lengthened, since the setting temperature is smaller than the print temperature, the fixing ability can be improved without changing heat-resistance temperatures of parts of the fixing apparatus.

Incidentally, other than the explanation of the illustrated embodiment, a timing for turning ON the ceramic heater 12 can be changed in accordance with the temperature of atmosphere in the ante-rotation. For example, by delaying the timing for turning ON the ceramic heater 12 by 1 second when the temperature of atmosphere is greater than 30° C. (including 30° C.), the increase in temperature of the pressurizing roller 11 can be suppressed under the high temperature environment, thereby keeping the temperature of the pressurizing roller 11 constant.

(Fifth Embodiment)

Next, a fifth embodiment of the present invention will be explained. Incidentally, the same elements as those in the first embodiment are designated by the same reference numerals and explanation thereof will be omitted.

In the fifth embodiment, the present invention is characterized in that the ante-rotation temperature adjustment temperature and the ante-rotation time are changed in accordance with the temperature of atmosphere, thereby improving the fixing ability.

In this embodiment, it is set so that, when the temperature of atmosphere is smaller than 10° C. (not including 10° C.), the ante-rotation temperature adjustment temperature is selected to 180° C. and the ante-rotation time is extended by 5 seconds, and, when the temperature of atmosphere is greater than 10° C. (including 10° C.) and smaller than 20° C., the ante-rotation temperature adjustment temperature is selected to 180° C. and the ante-rotation time is not extended, and, when the temperature of atmosphere is greater than 20° C. (including 20° C.), the ante-rotation temperature adjustment temperature is selected to 170° C. and the ante-rotation time is not extended.

By using such combinations, also in this embodiment, similar to the other embodiments, the hot offset can be prevented and good fixing ability can be obtained. Further, the specification of the printer can be enhanced in the point that the ante-rotation time is not required to be extended when the temperature of atmosphere is greater than 10° C. (including 10° C.).

Incidentally, other than the explanation in this embodiment, either the extension of the ante-rotation time or the ante-rotation temperature adjustment temperature may be changed in accordance with the temperature of atmosphere, or, as described in connection with the third embodiment, the extension of the ante-rotation time effected by using a value obtained with the predetermined linear function of the temperature of atmosphere may be combined.

The present invention is not limited to the above-mentioned embodiments, but, various alterations and modifications can be made within the scope of the invention.

What is claimed is:

1. An image forming apparatus comprising:

image forming means for forming an image on a recording material;

a heating member for heating the image on the recording material;

a backup roller forming a nip with said heating member;

a temperature detecting element for detecting a temperature of an atmosphere; and control means for controlling a power supply to said heating member;

wherein said control means has a mode in which, before a fixing operation, said heating member is temporarily maintained at a set temperature greater than a set temperature for the fixing operation in accordance with a detection temperature of said temperature detecting element, when a print signal is inputted.

2. An image forming apparatus according to claim 1, wherein the set temperature set before the fixing operation is effected is higher as the detection temperature of said temperature detecting element is lower.

3. An image forming apparatus according to claim 2, wherein highest value of the set temperature set before the fixing operation is effected is greater than the set temperature in the fixing operation.

4. An image forming apparatus according to claim 1, wherein, when said heating member is temperature-adjusted with the set temperature in accordance with the detection temperature of said temperature detecting element, said backup roller is rotated.

5. An image forming apparatus according to claim 1, wherein said heating member includes a heater for generating heat by being supplied power, and a film shiftable while being pinched between said heater and said backup roller.

6. An image forming apparatus according to claim 1, wherein said control means does not supply power to said heating member during waiting of the print signal.

7. An image forming apparatus comprising:

image forming means for forming an image on a recording material;

a heating member for heating the image on the recording material;

a backup roller forming a nip with said heating member;

a temperature detecting element for detecting a temperature of an atmosphere; and control means for controlling a power supply to said heating member;

wherein said control means has a mode in which, before a fixing operation, said heating member is maintained at a set temperature different from a set temperature for the fixing operation during a period corresponding to a detection temperature of said temperature detecting element, when a print signal is inputted.

8. An image forming apparatus according to claim 7, wherein the set time is longer as the detection temperature of said temperature detecting element is lower.

9. An image forming apparatus according to claim 7, wherein, further, the set time is longer as a size of the recording material is smaller.

10. An image forming apparatus according to claim 7, wherein said back up roller is rotated during the set time.

11. An image forming apparatus according to claim 7, wherein said heating member includes a heater for generating heat by being supplied power, and a film shiftable while being pinched between said heater and said backup roller.

12. An image forming apparatus according to claim 7, wherein said control means does not supply power to said heating member during waiting of the print signal.

13. An image forming apparatus comprising:

means for forming an image on a recording medium;

heat fixing means for heat fixing the image formed on the recording medium;

temperature detecting means for detecting a temperature of said heat fixing means; and control means for controlling an electric power supplied to said heat fixing means in such a manner that the temperature detected by said temperature detecting means becomes a predetermined fixing temperature;

wherein said control means has a mode in which a temperature higher than the fixing temperature is temporarily set as a target temperature before a fixing operation.

14. An image forming apparatus according to claim 13, further comprising environment temperature detecting means, wherein the target temperature is set in accordance with a detection result effected by said environment temperature detecting means.

15. An image forming apparatus according to claim 14, wherein the set temperature set before the fixing operation is effected is higher as the detection temperature of said environment temperature detecting means is lower.

16. An image forming apparatus according to claim 13, wherein said heat fixing means includes a heating member for heating an image formed on a recording material and a backup roller forming a nip with the heating member.

17. An image forming apparatus according to claim 16, wherein said heating member includes a heater for generating heat by being supplied power, and a film shiftable while being pinched between said heater and said backup roller.

18. An image forming apparatus according to claim 16, wherein said mode has a time period when the electric power supplied to said heat fixing means is controlled so that the temperature detected by said temperature detecting means in a condition where said backup roller is rotated becomes a set temperature higher than the set temperature in the fixing operation.

19. An image forming apparatus according to claim 13, wherein said mode is a first mode, and wherein said control means has a second mode in which the fixing operation is started without temporarily setting a temperature higher than the fixing temperature as a target temperature before the fixing operation.

20. An image forming apparatus according to claim 19, further comprising environment temperature detecting means, wherein said control means executes one of the first mode and second mode in accordance with a detection result of said environment temperature detecting means.

* * * * *

UNITED STATES PATENT AND TRADEMARK OFFICE

CERTIFICATE OF CORRECTION

PATENT NO. : 6,493,521 B2
DATED : December 10, 2002
INVENTOR(S) : Toshio Miyamoto et al.

It is certified that error appears in the above-identified patent and that said Letters Patent is hereby corrected as shown below:

Column 5,
Line 63, “becomes the” should read -- becomes --.

Column 7,
Line 61, “an” should read -- a --.
Line 64, “when” should read -- which --.

Column 10,
Line 52, “highest” should read -- a highest --.

Column 11,
Line 25, “back up” should read -- backup --.

Signed and Sealed this

Twelfth Day of August, 2003

JAMES E. ROGAN
*Director of the United States Patent and Trademark Office*